United States Patent [19]

Bodurow et al.

[11] Patent Number: 4,918,879

[45] Date of Patent: Apr. 24, 1990

[54] MERCHANDISING WALL STRUCTURE INCLUDING READILY ATTACHABLE AND DETACHABLE PANELS AND HAVING PLASTIC REVEALS

[75] Inventors: Constance C. Bodurow, Canton; Larry D. Murphy, New Philadelphia, both of Ohio; Gordon R. Perry, New York, N.Y.

[73] Assignee: Commercial and Architectural Products, Inc., Dover, Ohio

[21] Appl. No.: 56,141

[22] Filed: May 29, 1987

[51] Int. Cl.[5] ..... E04B 2/82

[52] U.S. Cl. ..... 52/36; 52/127.9; 52/238.1; 52/277; 52/282; 52/584

[58] Field of Search ..... 52/277, 276, 275, 280, 52/281, 282, 238.1, 239, 127.6, 127.7, 127.8, 127.9, 36, 243, 584, 582; 211/192; 248/243

[56] References Cited

U.S. PATENT DOCUMENTS

| | | | |
|---|---|---|---|
| 2,081,368 | 7/1935 | Pretot | 72/115 |
| 2,091,415 | 8/1937 | Mauser | 52/275 |
| 3,280,522 | 10/1966 | Palfrey et al. | 52/584 X |
| 3,332,182 | 7/1967 | Mark | 52/584 X |
| 4,020,613 | 5/1977 | Reynolds et al. | 52/127.9 X |
| 4,086,978 | 5/1978 | Clements | 52/36 |
| 4,180,003 | 12/1979 | Clement | 248/243 |
| 4,223,500 | 9/1980 | Clark et al. | 52/127.9 X |
| 4,334,374 | 6/1982 | Spamer et al. | 52/239 X |
| 4,370,838 | 2/1983 | Vermillion | 52/36 |
| 4,434,900 | 3/1984 | Cook | 211/189 |
| 4,493,174 | 1/1985 | Arens | 52/243 |
| 4,625,477 | 12/1986 | Johnstonbaugh | 52/127.9 |
| 4,625,677 | 12/1986 | Johnstonbaugh | 52/127.9 |

FOREIGN PATENT DOCUMENTS

| | | | |
|---|---|---|---|
| 650810 | 10/1962 | Canada | 52/239 |
| 1342059 | 9/1963 | France | 52/281 |
| 1527985 | 4/1968 | France | 52/275 |
| 696764 | 10/1965 | Italy | 52/238.1 |
| 1136374 | 12/1968 | United Kingdom | 52/127.9 |
| 2103260 | 2/1983 | United Kingdom | 52/238.1 |

OTHER PUBLICATIONS

Brochure (2 Pages) Hafele America (Giro-Bolt Lock).

*Primary Examiner*—Michael Safavi

*Attorney, Agent, or Firm*—Pearne, Gordon, McCoy & Granger

[57] ABSTRACT

A modular merchandising wall panel construction including at least two vertically oriented structural members in edge-to-edge engagement, and means affixing the structural members together and permitting ready disassembly thereof, comprising a vertically oriented standard affixed to the edge of one structural member, the standard being in the form of a channel having flanges extending therefrom, a wall of the channel having slots provided therein, and a plurality of rotary bolt locks mounted in the edge of the other structural member, the rotary bolt lock having an arcuate bolt engaging the slots of the vertical standard, thereby locking the structural members together, and permitting easy disassembly thereof. In one embodiment of the invention some of the structural members comprise pilasters also having rotary bolt locks or vertical standards for assembly with the other structural members. In a further improved embodiment plastic reveals are inserted between the walls of the standard and the edges of the structural members to provide a more secure joint and also to improve the esthetic appearance of the modular structure.

9 Claims, 9 Drawing Sheets

MERCHANDISING WALL STRUCTURE INCLUDING READILY ATTACHABLE AND DETACHABLE PANELS AND HAVING PLASTIC REVEALS

BACKGROUND OF THE INVENTION

1. Field of the Invention

The present invention relates to a merchandising wall structure which may be free-standing or anchored to a wall, and more particularly refers to a wall structure formed of individual panels which are attached to frame members of the wall structure, and have plastic reveals mounted intermediate the panels and the frame members.

2. Description of the Prior Art

Vertical merchandising walls are widely used in commercial establishments for the display of a wide variety of items. The display apparatus is universal and may be assembled to take a wide variety of shape and form configurations to accommodate a particular size and motif in a display area or showroom. The wall structures are generally formed of a plurality of panels which, in cooperation with frame members, are adapted to be readily assembled and disassembled, and which wall structures provide a functional and aesthetically appealing means for displaying a wide variety of articles. A wall of the type described is disclosed and claimed in U.S. Pat. No. 4,434,900. The edges of the individual panels are assembled to each other edge-wise by means of keyholes provided in the edge of one panel which engage screwheads provided in a post or another panel. Although this structure has been found adequate for many uses, it has the disadvantage that the panels or posts must be lifted in order for the screwheads to be engaged in the keyhole slots in an adjacent member.

In U.S. Pat. No. 4,625,477 a wall structure is disclosed which is comprised of a plurality of wall panels and metal standards or posts of tubular structure which are easily connected to each other by means of rotary latches retained in mortises provided in the edges of the panel members or related structures, and which latches are adapted to engage slots provided in the metal standard or post structures or other panel edges. The structures are engaged by sliding them together without the necessity for lifting any of them, inserting a key into an aperture of the latch mechanism, and rotating the key until an arcuate latch member of the latch mechanism engages slots in the standard affixed to an adjacent structure and latches the structures together. The latching structure has the advantage that it is recessed within the edges of the panels and therefore does not detract from the aesthetic appearance of the panels. Moreover, the latches may be readily engaged and disengaged by a simple rotation of a key inserted in the key aperture provided in the latch and in the panel. The standard disclosed is in the form of a square tube which is extruded from aluminum. Although this standard support structure has been found to be eminently suitable for the purpose, the cost of the aluminum extrusion is somewhat higher than would be desirable.

SUMMARY OF THE INVENTION

It is accordingly an object of the present invention to provide a new and improved vertical merchandising wall structure suitable for use in commercial establishments for various functions including the display of a wide variety of items, as well as for use as a wall structure generally.

It is a further object to provide a wall structure wherein a plurality of panels and posts may be relatively easily assembled and disassembled without the necessity for lifting the panel members and posts to engage and disengage the locking structures. This results in reduced installation time and costs and the involvement of fewer construction trades in the field.

It is still further an object of the invention to provide a wall structure of the type described having components which may be relatively inexpensively fabricated.

It is additionally an object to provide a wall structure having various improvements in both mechanical and esthetic features not exhibited in prior art structures.

These and other objects, advantages and functions of the invention will be apparent upon reference to the specification and attached drawings illustrating preferred embodiments of the invention, in which like parts are identified by like reference symbols in each of the views.

According to the invention, a merchandising wall structure is provided comprised of a plurality of wall panels and metal standards or posts, and for some applications pilasters, which are easily connected to each other by means of rotary latches retained in mortises provided in the edges of the panel members adapted to engage slots provided in metal standards or post structures or other structural edges. The metal standards or post structures are formed from sheets of cold rolled steel shaped in the form of a web, a pair of panel members extending one from each of the edges of the web and oriented substantially perpendicularly with respect to the web, and flanges extending one from each of the edges of the panel members and substantially perpendicular thereto, the flanges extending in opposite directions from each other. The structures are engaged by sliding them together without lifting, inserting a key in an aperture of the latch mechanism, and rotating the key until an arcuate latch member engages slots provided in the standard of an adjacent member and latches the two members together. The latching structure has the advantage that it is recessed within the edges of the panels and therefore does not detract from the aesthetic appearance of the panels. Moreover, the latches may be readily engaged and disengaged by a simple rotation of the key inserted in the key aperture provided in the latch and in the panel. Additional features of the invention include the provision of plastic reveals intermediate the standards and adjacent structures and dimpling and swagging structures provided in the walls of the standards.

DESCRIPTION OF THE PREFERRED EMBODIMENTS

Figure 1:
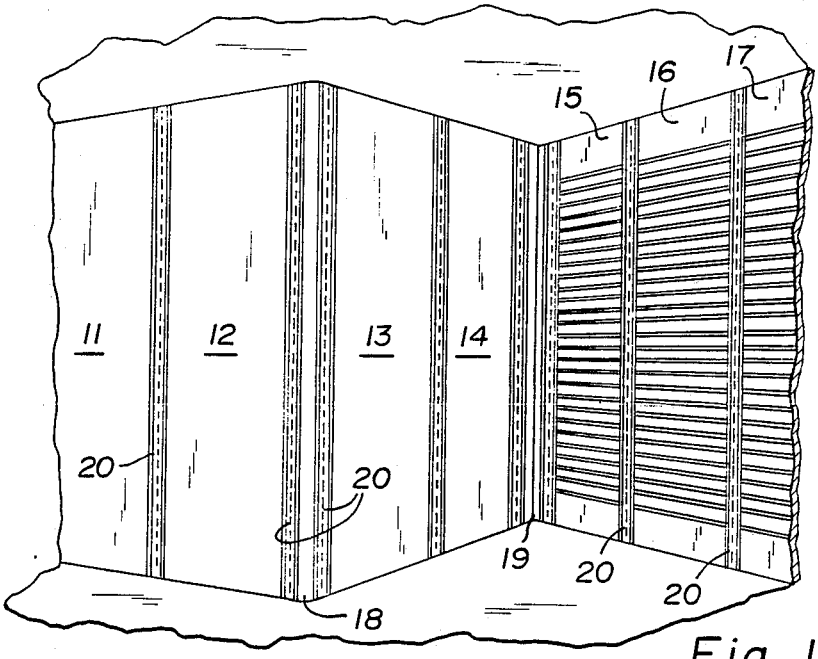
FIG. 1 is a perspective view of a modular merchandising wall structure according to the invention, assembled from a plurality of wall panels, pilasters and standards.
Figure 2:
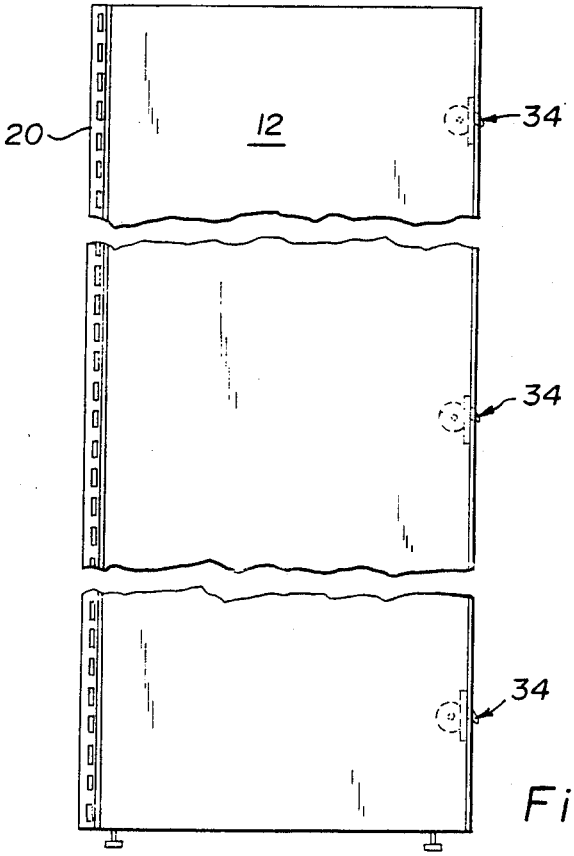
FIG. 2 is an elevational view of a single wall panel.
Figure 3:
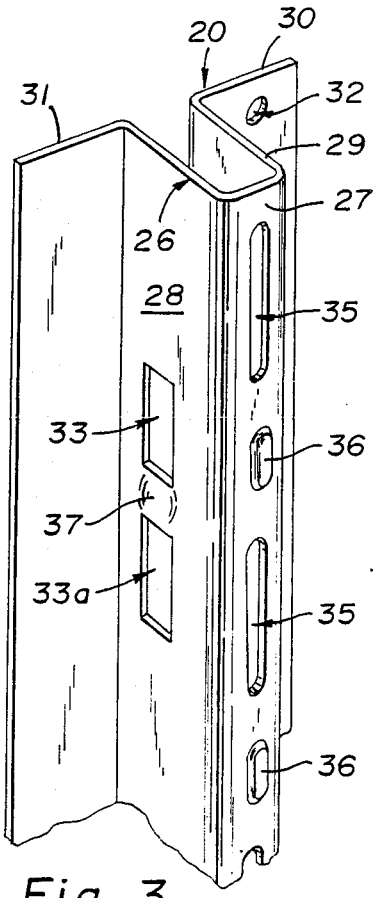
FIG. 3 is a perspective fragmentary view of a vertical standard according to the invention.
Figure 4:
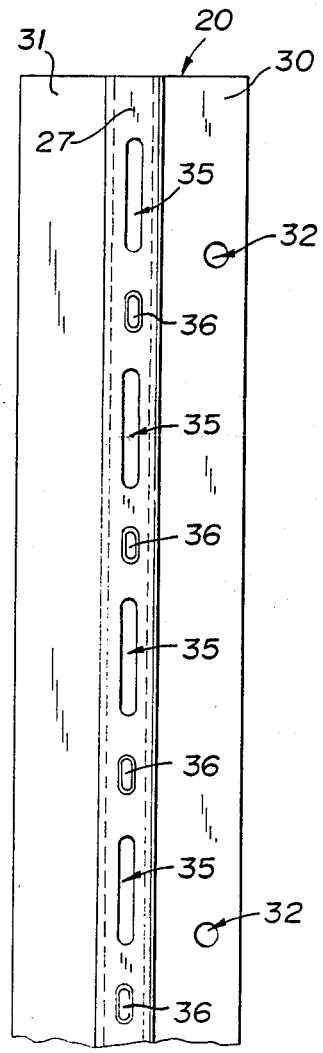
FIG. 4 is a fragmentary front view of the standard shown in FIG. 3.
Figure 5:
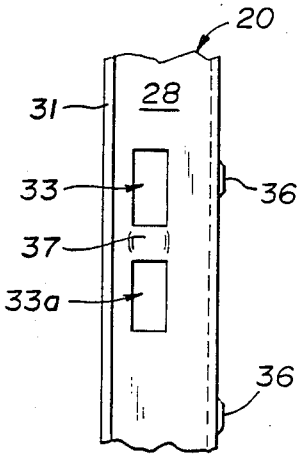
FIG. 5 is a left-edge view of the standard.
Figure 6:
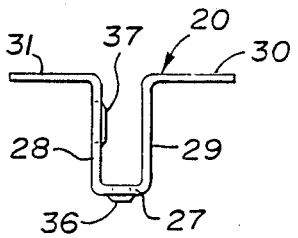
FIG. 6 is an end view of a standard as shown in FIGS. 3–5.
Figure 7:
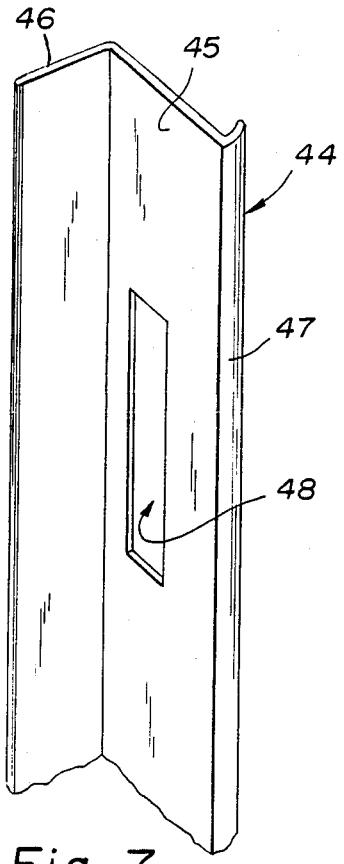
FIG. 7 is a perspective view of a plastic trim or reveal member.
Figure 8:
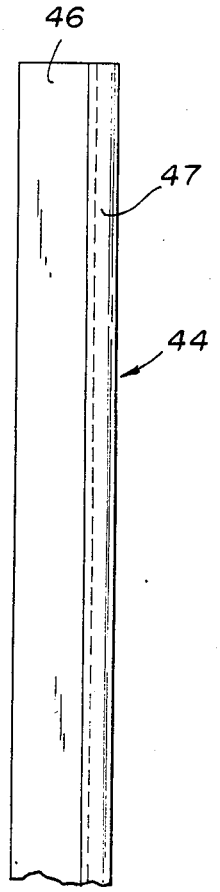
FIG. 8 is an elevational view of the trim or reveal member of FIG. 7 showing the front portion.
Figure 9:
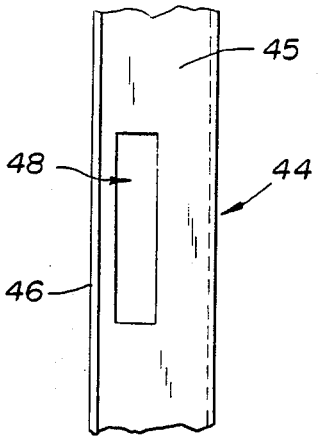
FIG. 9 is a fragmentary elevational view of the left side of the plastic trim or reveal member of FIGS. 7 and 8.
Figure 10:
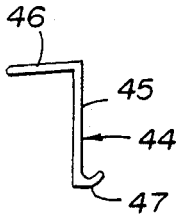
FIG. 10 is an end view of the trim or reveal member of FIGS. 7–9.

Referring to FIG. 1, a modular merchandising wall panel construction 10 is shown comprising a plurality of smooth wall panels 11, 12, 13 and 14, and display panels 15, 16 and 17 having horizontal grooves for mounting display brackets. The corners of the modular construction are formed by anular pilasters 18 and 19. Each joint is formed by a standard 20 co-operating with bolt locks mounted in mortised recesses at the edges of the complementary mating structure. The standards 20 are preferably formed of cold rolled steel.

Referring to FIGS. 3, 4, 5, and 6, a standard 20 is shown in the form of a channel structure 26 having a front wall 27, a left sidewall 28 and a right sidewall 29. An attachment flange 30 extends from the right sidewall 29, and a guide flange 31 extends from and is positioned perpendicular to the left sidewall 28, apertures 32 are provided in the attachment flange 30 for attaching the flange 30 to a wall panel. Pairs of slots 33 and 33*a* are provided in the left sidewall 28 for receiving lock bolts. Slots 35 are provided in the front wall 27 for receiving bracket inserts for supporting the majority of the load placed on the system in terms of merchandise and display hardware. Face dimples 36 are pressed into the front wall 27 intermediate the slots 35. The use of steel and the use of the cold rolling process to form the standard permits the standard to have incorporated therein the unique dimpling feature according to the invention. The dimples may be applied during the rolling process in any desired magnitude. This permits material of different thicknesses to be utilized to form the standard. When steel is used in forming the standards, because of its strength, thinner material may be utilized than would be required if the standards were formed of a weaker material such as aluminum. The presence of the dimples 36 in any desired elevation permits a thin steel sheet to be used in forming the standards while still enabling conventional brackets to be used without the necessity for redesigning the brackets to accommodate the thinner steel. Thus, brackets which are designed to be mounted on aluminum structure incorporating a thicker metal insert than the steel sheet of which the present standards are formed may be utilized and the presence of the dimples 36 compensate for the difference in thickness of the metal, thereby permitting conventional brackets to be utilized.

As an additional feature of the invention, areas intermediate the pairs of slots 33 and 33*a* are provided with protuberances 37 during the rolling process. This structure permits thin steel sheeting to be used while still providing sufficient strength to the areas between the slots 33 and 33*a* to be engaged by the arcuate bolt 56 without bending.

Referring to FIGS. 7–10, a reveal or trim member 44 is shown comprising a web 45, an attachment flange 46, and a face trim flange 47. A slot 48 is provided in the web 45 to permit a lock bolt to extend therethrough for engaging a standard 20. The reveal or trim member 44 may be formed of a plastic material such as polyvinyl chloride or other suitable plastic materials. A pair of reveals 44 are utilized with each standard 20, one reveal may be affixed to the attachment flange by means of screws extending through the attachment flange 46 of the reveal, and a second reveal may be attached to the guide flange 31 by means of staples passing through the attachment flange 46 of the reveal 44, the face trim flanges of both reveals extend over the front wall 27 of the standard 20. The reveals 44 provide several advantages. The reveal functions as a padding agent to assure that the joint between the panel/pilaster and steel standard is solid and does not rattle. The reveal also has an aesthetic function. It wraps the face of the steel standard, adding a radiused, softening element to the transition between the plain of the structural component face and the plain of the standard face. Additionally it visually reduces the width of the joint, making the vertical standard appear with less overall impact in the installation. The reveal can also be formed of materials having various integral colors, thereby providing a coloration concept for the system. All the component parts of the system, the panels, pilasters, steel standards, vinyl reveals, vinyl back caps and vinyl groove inserts are readily available in standard materials and may be promoted in matching colors. The ability to bring the various elements together in a homogeneity of elements in a complete system to achieve a completely monochromatically appearance provides another valuable feature of the system of the invention.

Figure 11:
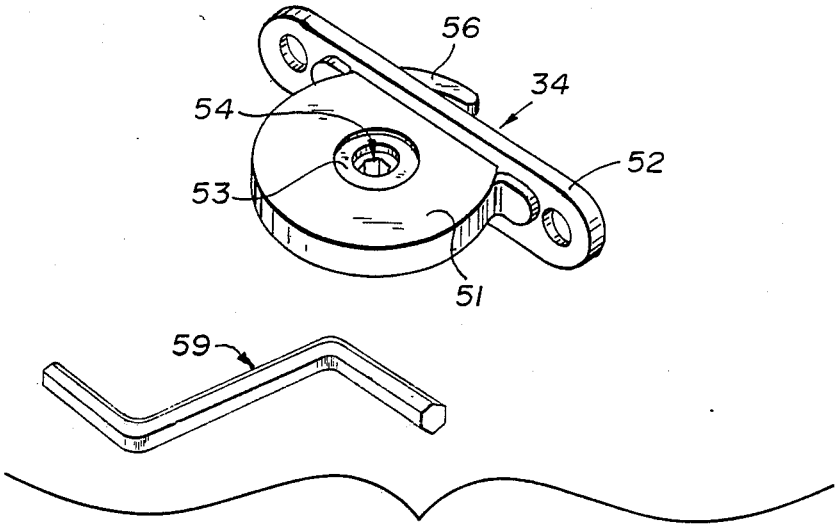
FIG. 11 is a perspective view of a lock assembly according to the invention.
Figure 12:
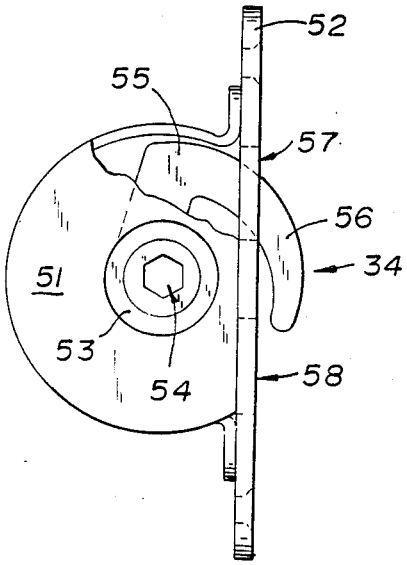
FIG. 12 is an elevational view of the locking mechanism shown in FIG. 11.

Referring to FIGS. 11 and 12, a bolt lock assembly 34 is shown. The bolt lock 34 is generally known in the trade a GIRO-bolt lock marketed by the Hafele American Company, High Point, N.C. As shown in FIGS. 11 and 12, this structure includes a housing 51 having a mounting plate 52 affixed thereto. A rotatable hub 53 is mounted in the housing and is provided with a hexagonal aperture 54. A radial arm 55, shown in FIG. 12, is connected to the hub 53 at one end and has an arcuate bolt 56 connected at the other end and extending through an aperture 57 provided in the mounting plate 52, and adapted, upon rotation of the hub 53, to enter a second aperture 58 also provided in the mounting plate 52. The assembly additionally includes an Allen crank wrench 59 having a hexagonal cross-section adapted to be inserted into the hexagonal aperture 54 of the hub 53.

Figure 13:
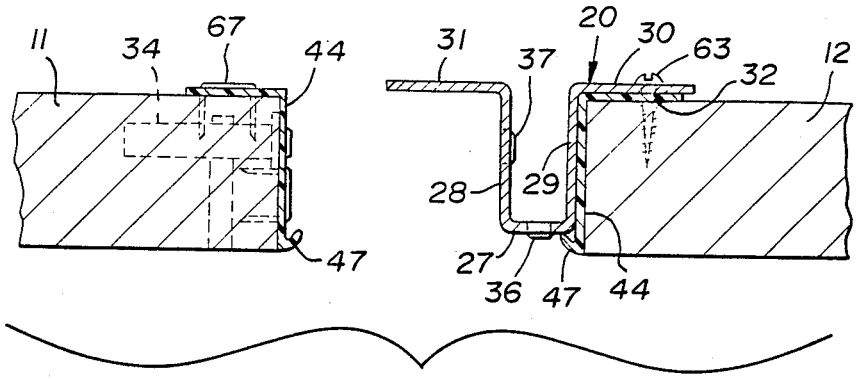
FIG. 13 is a cross-sectional view of a joint between two wall panels in disassembled form.
Figure 14:
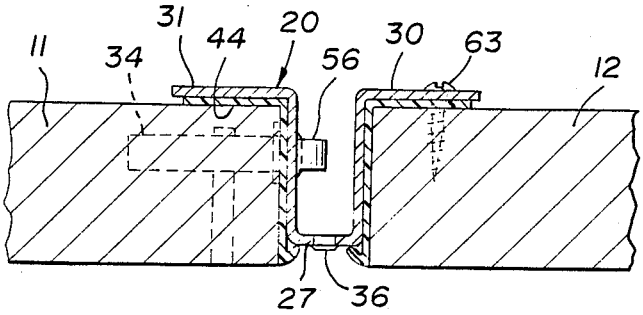
FIG. 14 is a cross-sectional view of the two wall panels of FIG. 13 in assembled condition.

Referring to FIGS. 13 and 14, a pair of wall panels 11 and 12 are shown. In FIG. 13 the panels are in disassembled state. The panel 11 has a bolt lock 34 recessed in a mortise 65 therein and a reveal 44 affixed thereto by staples 67. The panel 12 has a standard 20 affixed thereto by means of screws 63 extending through apertures 32,. A reveal 44 is mounted between the standard 20 and the panel 12.

FIG. 14 shows the structure of FIG. 13 after the panel 11 has been put in place in engagement with the guide flange 31 and left sidewall 28, and the bolt lock rotated until the arcuate bolt 56 is locked in place.

Figure 15:
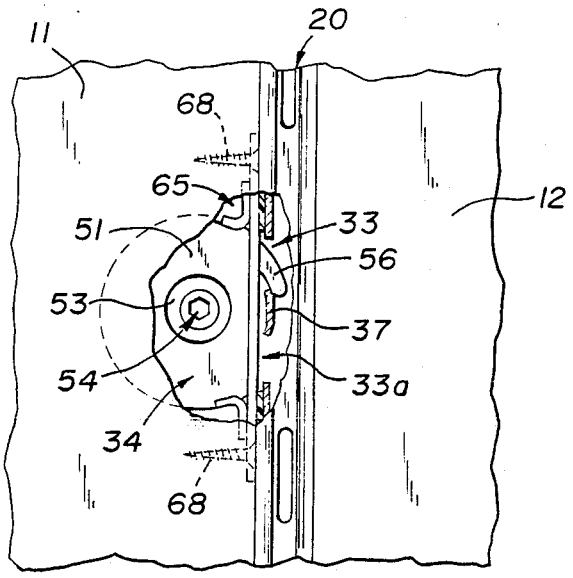
FIG. 15 is an elevational view, partly broken away, of a joint between two wall panels with the bolt in unlocked position.
Figure 16:
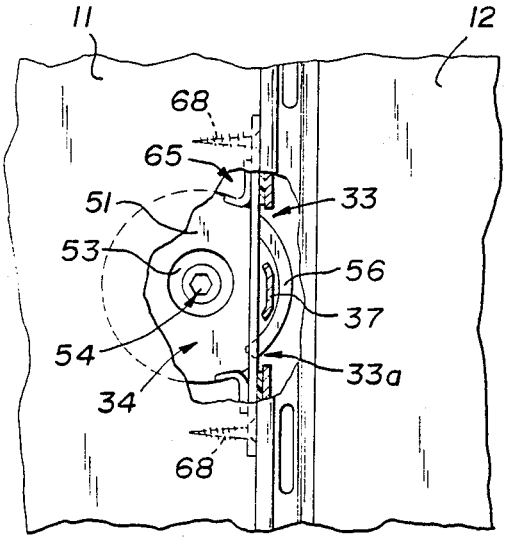
FIG. 16 is an elevational view, partly broken away, of the structure shown in FIG. 15 with the bolt in locked position.

Referring to FIGS. 15 and 16, a pair of wall panels 11 and 12 are shown. The wall panel 12 has a metal standard affixed thereto. New wall panel 11 has a plurality of mortised recesses 65 provided therein in which are mounted rotary bolt locks 34 affixed to the wall panel 11 by means of screws 68. As shown in FIG. 15, the hub 53 has been rotated by inserting the crank-shaped Allen wrench 59 into the hexagonal aperture 54 and turning the crank until the arcuate bolt 56 has just entered the first slot 33 of the metal standard 20. FIGS. 16 shows the assembly after the crank has been further rotated and the arcuate bolt 56 penetrated and passed through the second slot 33*a* of the pair of slots of the metal standard 20. In this condition the two walls are firmly locked together and can not be pulled apart. The locked condition is also shown in FIG. 14.

Figure 17:
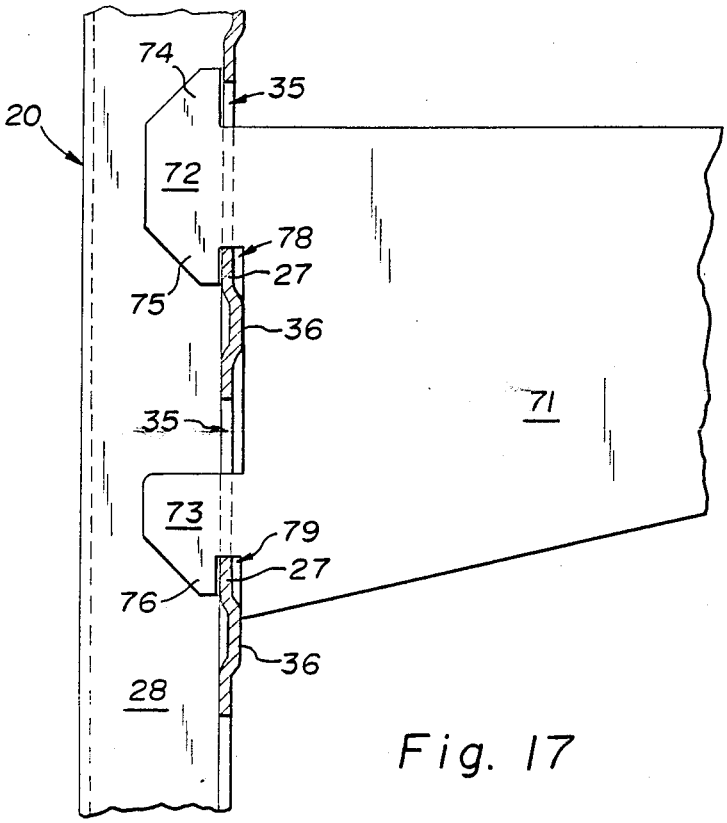
FIG. 17 is a view of a standard partly in cross-section having a supporting bracket mounted thereon.

Referring to FIG. 17, a standard 20 is shown having a bracket 71 mounted therein and useful for supporting shelves and other related items. The bracket has inserts 72 and 73 extending into slots 35 of the standard. The insert 72 has legs 74 and 75, the leg 75 defining a recess 78 engaging a portion of the front wall 27. The insert 73 has a leg 76 defining a recess 79 engaging a portion of the front wall 27. As a result the bracket is maintained in place. Conventionally the recesses 78 and 79 are designed to engage thick-walled extruded or stamped metal and are therefore quite wide. In order to permit the utilization of conventional brackets with wide recesses, dimples 36 are provided in the front wall 27 to take up the additional space and prevent excessive play of the structure.

Figure 18:
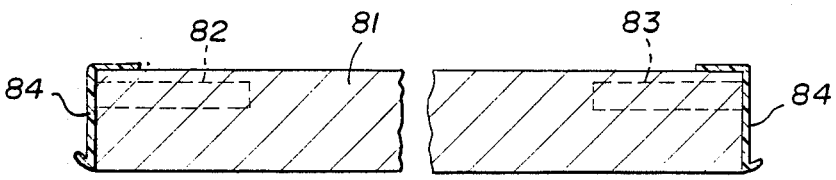
FIG. 18 is a cross-sectional view of a wall panel being mortised at both edges to receive a bolt lock.

Referring to FIG. 18, a wall panel 81 is shown having mortises 82 and 83 provided at its edges for receiving bolt locks. Reveals 84 are affixed to the edges by suitable means such as staples.

Figure 19:
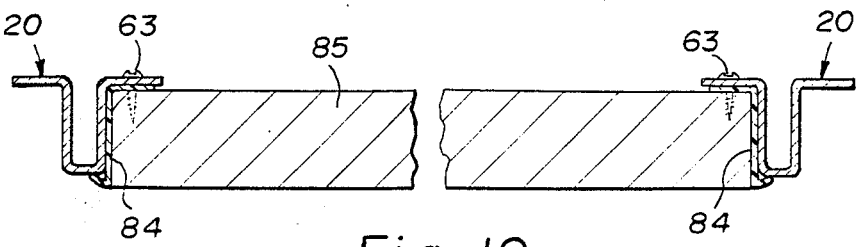
FIG. 19 is a fragmentary cross-sectional view of a wall panel having a standard at both edges.

Referring to FIG. 19, a panel 85 is shown having standards 20 and reveals 84 affixed thereto by screws 63.

The modular merchandising wall panel construction of the present invention is extremely versatile. Joints may be formed between wall panels of many different styles such as decorative wall panels and display-type wall panels. In order to form a joint, it is only necessary that one structural member has a standard according to the invention affixed thereto by means of screws or other suitable fastening means, and the other structural member must have mortises provided in a plurality of positions in which rotary bolt locks are inserted and affixed. In order to connect two structural members together, they need only be made to slide together, and the crank inserted into the hexagonal apertures of the locks and rotated until the arcuate bolt 56 enters the first slot 33 of each standard, the crank being further rotated until the bolt end returns and enters and emerges from the second slot 33*a* of the standard. In this condition the two structures are locked together and cannot be pulled apart. For connecting structural members such as wall panels it is desirable to have at least one rotary bolt lock provided for each 3 feet of structural edge, and an equal number of pairs of slots provided in the standard of the other structural member for each rotary bolt lock used in the first structural member. In connecting two structural members such as two wall panels together, it is only necessary to slide the two panels together until their edges meet, and then rotate the hub of each rotary bolt lock until the arcuate bolt of each lock engages the slots of the metal standard. The two structures are then firmly locked together and cannot be pulled apart.

In order to assembly a plurality of wall panels, each panel may be provided with one metal standard at one edge and a plurality of rotary bolt locks at the other edge, as shown and described in FIGS. 13–16. Alternatively, as shown in FIG. 18, a wall panel 81 may be provided having mortises 82 and 83 in which rotary bolt locks 34 according to the invention may be provided at both edges. The panel may then be connected at both ends to structural members having standards.

FIG. 19 shows a wall panel 85 having standards 20 mounted one at each edge. Each edge may be then mounted to another structural member which has a plurality of rotary bolt locks 34 mounted therein.

The modular wall panel construction of the present invention may be affixed by means of suitable brackets to a permanent wall structure, or, alternatively, may be free-standing. In order for the structure to be free-standing in straight runs, a structural post which incorporates the elongate standard must be used. Otherwise, some of the wall panels must be oriented at an angle with respect to the others. In order to provide for this, the present invention includes structural members in the form of pilasters or posts. The pilasters may be provided with any desired angular shape, and may have either standards or rotary bolt locks at its edges.

Figure 20:
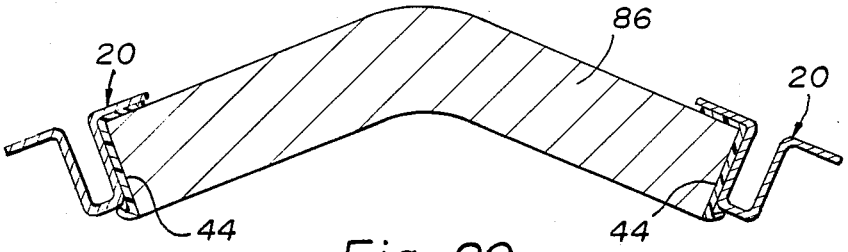
FIG. 20 is a cross-sectional view of a pilaster in the form of an obtuse angle having a standard at both edges.

In FIG. 20 is shown a pilaster 86 whose legs are at an obtuse angle with respect to each other. Affixed to the ends of the pilaster are a pair of standards 20 and reveals 44. Alternatively, a plurality of rotary bolt locks 34 may be substituted at one or both edges.

Figure 21:
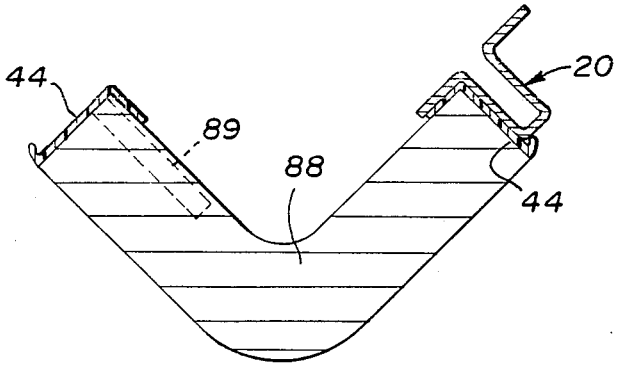
FIG. 21 is a cross-sectional view of a pilaster in the form of a right angle having a mortise at one edge and a standard at the other edge.

In FIG. 21 is shown a pilaster 88 in the form of a right angle. Here a plurality of mortises 89 and reveals 44 are provided at one edge adapted to receive a plurality of rotary bolt locks 34. A standard 20 and reveal 44 are affixed to the other edge. Wall panels may then be affixed to the edges of the pilaster by means of complementary locking means. Since the walls affixed to the pilaster 88 will be at right angles, the structure will be free-standing.

Figure 22:
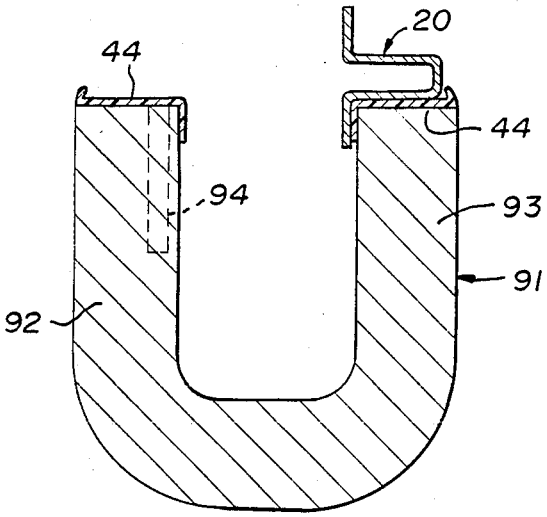
FIG. 22 is a pilaster of U-shaped cross-section having a mortise at one edge and a standard at the other.

Referring to FIG. 22 a pilaster 91 is shown having a U-shaped cross-section. The structure comprises legs 92 and 93, one having a mortise 94 provided to receive a bolt lock 34 and the other being provided with a metal standard 20 and reveal 44 adapted to be attached to wall panels having bolt locks 34.

Figure 23:
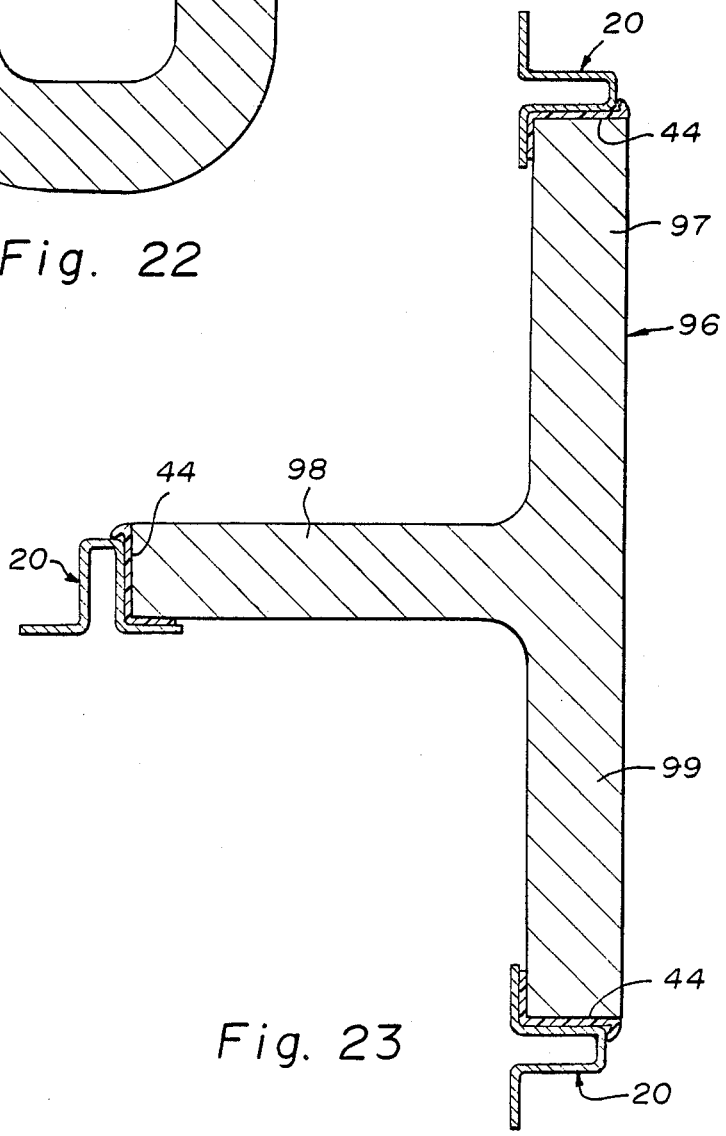
FIG. 23 is a cross-sectional view of a pilaster having a T-shaped cross-section with a standard mounted at each edge.

Referring to FIG. 23, a pilaster 96 is shown having a T-shaped cross-section comprised of legs 97, 98 and 99.

Metal standards 20 and reveals 44 are provided at the end of each leg for being connected to wall panels having bolt locks.

The modular merchandising wall panel instruction of the present invention has a number of advantages over the structures of the prior art. First, in contrast to the case of fastening means such as keyholes and bolts, the panels of the present structure need not be lifted in order to engage their edges. It is only necessary to slide the panels together until their edges are in engagement. Then the Allen wrench crank is inserted in the hex apertures of the bolt locks and turned until the bolts engage the slots of the metal standard of the adjoining structural member. Once the bolts are engaged, the struetural members cannot be pulled apart, but can only be released by rotating the bolts in the opposite direction. Many different types of panels may be affixed together. The structure may be made free-standing by utilizing a pilaster to connect the wall panels at an angle. Wall panels may be connected to wall panels and wall panels may be connected to pilasters. It is only necessary that the engaging edge of one structural member be provided with a metal standard having appropriately placed pairs of engagement slots, and the edge of the other structural member be provided with a plurality of bolt locks at positions where they may engage the slots of the metal standard. A simple rotation of the Allen wrench crank will then firmly lock the members together. The bolt locks are commercially made and may be readily obtained in the market. The metal standard may be readily formed by stamping or rolling a relatively inexpensive material such as sheet steel, and then machined to provide the proper engagement slots. Modular structures may then be assembled such as the one shown in FIG. 1. Infinite configurations and site requirements can thus be accommodated.

Secondly, structures of the prior art require elaborate and costly wall preparation for structural integration. Existing building walls must be furred, and numerous horizontal and vertical channels must be applied in order to create an intra-structure to which the decorative wall or display-type panels are then applied. No such preparation methods or costs are required of the invention described herein.

A further advantage of the invention results from the fact that the use of reveals of various colors enables systems according to the invention to be marketed and assembled in any of a number of monochromatic patterns. The reveals additionally function as padding agents to enable the joints between the structural elements to secure and quiet.

It is to be understood that the invention is not to be liminted to the exact details of construction or operation or materials shown and described, as obvious modifications and equilvalents will be apparent to those skilled in the art.

Invention is claimed as follows:

1. A modular merchandising wall panel construction including at least first and second vertically oriented structural members having vertical edges, said structural members in edge-to-edge lateral engagement, and means affixing said structural members together and permitting ready disassembly thereof, said means comprising a plurality of recesses provided in an edge of a first one of said structural members and a rotary bolt lock affixed within each recess, and an elongate vertical standard affixed at an edge of the second one of said structural members, A. each of said rotary bolt locks comprising:

(1) a housing having an opening at an edge thereof, (2) a hub rotatably mounted in said housing and having an aperture provided therein adapted to receive a driving means, (3) a radial arm affixed to said hub, (4) an arcuate bolt extending from an end of said radial arm; and B. said elongate standard comprising:

(1) a steel channel-form body member including a web having spaced apart parallel edges, a pair of sidewalls one extending from each edge of said web, said sidewalls being oriented substantially parallel to each other and substantially perpendicular to said web, and each sidewall having an edge spaced apart from the associated edge of said web, and (2) a pair of laterally outwardly extending flanges one extending from said edge of each of said sidewalls, said flanges comprising a mounting flange engaging a face of the second of said structural members and having an aperture provided in said flange and affixing means extending through said aperture and engaged in said second structural member, and a guide flange for engaging the first of said structural members, the sidewall connected to said guide flange being provided with a plurality of pairs of slots, one pair of slots being juxtaposed opposite each of said rotary lock bolts of said first structural member; wherein said two structural members are solidly affixed together edge-to-edge with said elongate standard therebetween, the arcuate bolt of said rotary bolt lock emerging from the aperture of said housing, entering the first slot of one of said pairs of slots in said standard sidewall and returning through the second slot.

2. A modular merchandising wall panel construction according to claim 1, wherein a plurality of slots are provided in the web of said vertical standard for mounting display brackets thereon.

3. A modular merchandising wall panel construction according to claim 1, wherein said structural members comprise two adjoining wall panels.

4. A modular merchandising wall panel construction according to claim 1, wherein said structural members comprise one panel and one adjoining pilaster.

5. A modular merchandising wall panel construction according to claim 4, wherein said pilaster is comprised of two members disposed at a right angle to each other.

6. A modular merchandising wall panel according to claim 4, wherein said pilaster is comprised of two members disposed at an obtuse angle with respect to each other.

7. A modular merchandising wall panel construction according to claim 1, additionally comprising first and second Z-shaped trim members, said first trim member disposed between said first structural member edge and said elongate standard, said second trim member disposed between said second structural member edge and said elongate standard, each trim member comprising a web, a mounting flange, and a decorative flange, the web of one of said trim members being provided with a slot to permit the arcuate bolt of said rotary bolt lock to pass therethrough, the decorative flange of each trim member engaging the web of said vertical standard.

8. A modular merchandising wall panel construction including at least first and second vertically oriented structural members having vertical edges, said structural members in edge-to-edge lateral engagement, and means affixing said structural members together and permitting ready disassembly thereof, said means comprising a plurality of recesses provided in an edge of a first one of said structural members and a rotary bolt lock affixed within each recess, and an elongate vertical standard affixed at an edge of the second one of said structural members, A. each of said rotary bolt locks comprising:

(1) a housing having an opening at an edge thereof, (2) a hub rotatably mounted in said housing and having an aperture provided therein adapted to receive a driving means, (3) a radial arm affixed to said hub, (4) an arcuate bolt extending from an end of said radial arm; and B. said elongate standard comprising:

(1) a steel channel-form body member including a web having spaced apart parallel edges, a pair of sidewalls one extending from each edge of said web, said sidewalls being oriented substantially parallel to each other and substantially perpendicular to said web, and each sidewalls having an edge spaced apart from the associated edge of said web, said web provided with outwardly extending dimples for cooperating to support display brackets of various contours mounted thereon, and (2) a pair of laterally outwardly extending flanges one extending from said edge of said of said sidewalls, said flanges comprising a mounting flange engaging a face of the second of said structural members and having an aperture provided in said flange and affixing means extending through said aperture and engaged in said second structural member, and a guide flange for engaging the first of said structural members, the sidewalls connected to said guide flange being provided with a plurality of pairs of slots, one pair of slots being juxtaposed opposite each of said rotary lock bolts of said first structural member; wherein said two structural members are solidly affixed together edge-to-edge with said elongate standard therebetween, the arcuate bolt of said rotary bolt lock emerging from the aperture of said housing entering the first slot of one of said pairs of slots in said standard sidewall and returning through the second slot.

9. A modular merchandising wall panel construction including at least first and second vertically oriented structural members having vertical edges, said structural members in edge-to-edge lateral engagement, and means affixing said structural members together and permitting ready disassembly thereof, said means comprising a plurality of recesses provided in an edge of a first one of said structural members and a rotary bolt lock affixed within each recess, and an elongate vertical standard affixed at an edge of the second one of said structural members, A. each of said rotary bolt locks comprising:

(1) a housing having an opening at an edge thereof, (2) a hub rotatably mounted in said housing and having an aperture provided therein adapted to receive a driving means, (3) a radial arm affixed to said hub, (4) an arcuate bolt extending from an end of said radial arm; and B. said elongate standard comprising:

(1) a steel channel-form body member including a web having spaced apart parallel edges, a pair of sidewalls one extending from each edge of said web, said sidewalls being oriented substantially parallel to each other and substantially perpendicular to said web, and each sidewall having an edge spaced apart from the associated edge of said web, and (2) a pair of laterally outwardly extending flanges one extending from said edge of each of said sidewalls, said flanges comprising a mounting flange engaging a face of the second of said structural members and having an aperture provided in said flange and affixing means extending through said aperture and engaged in said second structural member, and a guide flange for engaging the first of said structural members, the sidewalls connected to said guide flange being provided with a plurality of pairs of slots and protuberances in said sidewalls disposed between the slots of each of said pairs of slots, one pair of slots being juxtaposed opposite each of said rotary lock bolts of said first structural member; wherein said two structural members are solidly affixed together edge-to-edge with said elongate standard therebetween, the arcuate bolt of said rotary bolt lock emerging from the aperture of said housing entering the first slot of one of said pairs of slots in said standard sidewall and returning through the second slot.

* * * * *

UNITED STATES PATENT AND TRADEMARK OFFICE

CERTIFICATE OF CORRECTION

PATENT NO. : 4,918,879

DATED : April 24, 1990

INVENTOR(S) : Constance C. Bodurow, et al.

It is certified that error appears in the above-identified patent and that said Letters Patent is hereby corrected as shown below:

On the face of the patent, under References Cited, the last U.S. Reference (4,625,677) should be omitted.

Col. 9, line 25, "sidewalls" should be --sidewall--.

Col. 9, line 32, "said" (2nd occurrence) should be --each--.

Col. 9, line 41, "sidewalls" should be --sidewall--.

Col. 10, line 38, "sidewalls" should be --sidewall--.

Signed and Sealed this

Fourth Day of June, 1991

*Attest:*

HARRY F. MANBECK, JR.

*Attesting Officer*

*Commissioner of Patents and Trademarks*